United States Patent [19]

Henry et al.

[11] Patent Number: 5,007,642

[45] Date of Patent: Apr. 16, 1991

[54] COMPARATOR

[76] Inventors: Mark Henry, 558 Ramona St., Sierra Madre, Calif. 91024; Hillary Saenz, 724 E. Chestnut St., Glendale, Calif. 91205

[21] Appl. No.: 493,710

[22] Filed: Mar. 15, 1990

[51] Int. Cl.[5] ..... A63F 3/06

[52] U.S. Cl. ..... 273/148 R

[58] Field of Search ..... 273/148 R, 148 A; 434/199, 405, 410

[56] References Cited

U.S. PATENT DOCUMENTS

| | | | |
|---|---|---|---|
| 1,248,238 | 11/1917 | Young | 434/199 |
| 3,377,717 | 4/1968 | Rowe | 434/199 |
| 3,491,193 | 1/1970 | Bianchi | 434/199 X |
| 4,600,198 | 7/1986 | Fox | 273/148 R |
| 4,772,025 | 9/1988 | James et al. | 273/148 R |
| 4,781,379 | 11/1988 | Parks | 273/148 R |

*Primary Examiner*—William H. Grieb

*Attorney, Agent, or Firm*—James E. Brunton

[57] ABSTRACT

A comparator device for use in comparing a first series of numbers written on a writing surface provided on the face of the device with a second series of numbers imprinted on a sheet of paper which can be fed through an internal passageway formed between the facing assembly of the device and a backing member so the numbers can be viewed through a reading window provided with a magnifying glass for magnifying the second series of numbers.

11 Claims, 1 Drawing Sheet

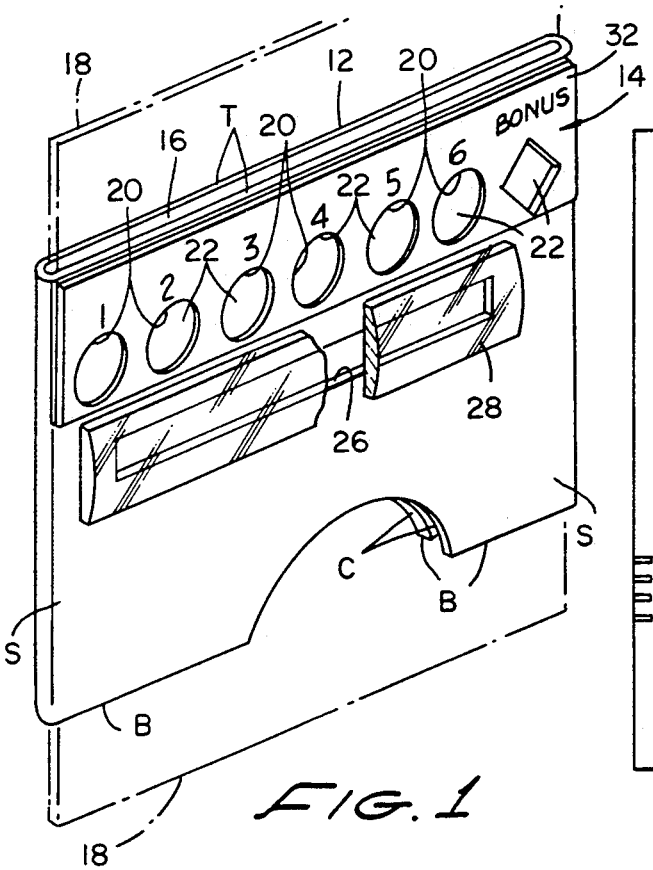
FIG. 1
FIG. 2
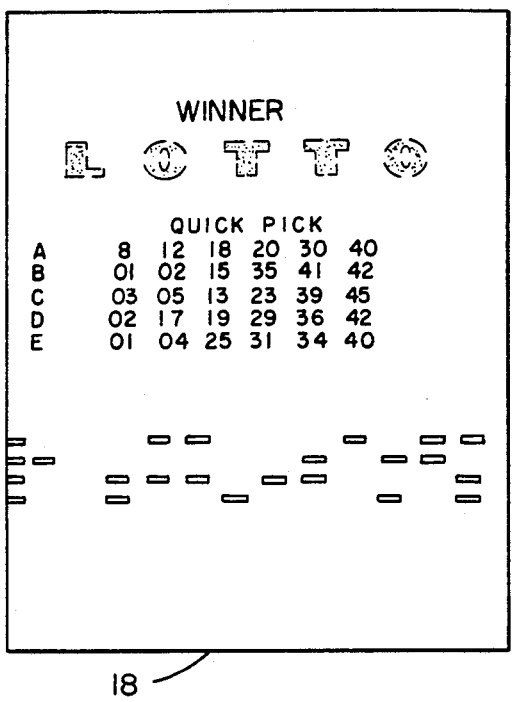
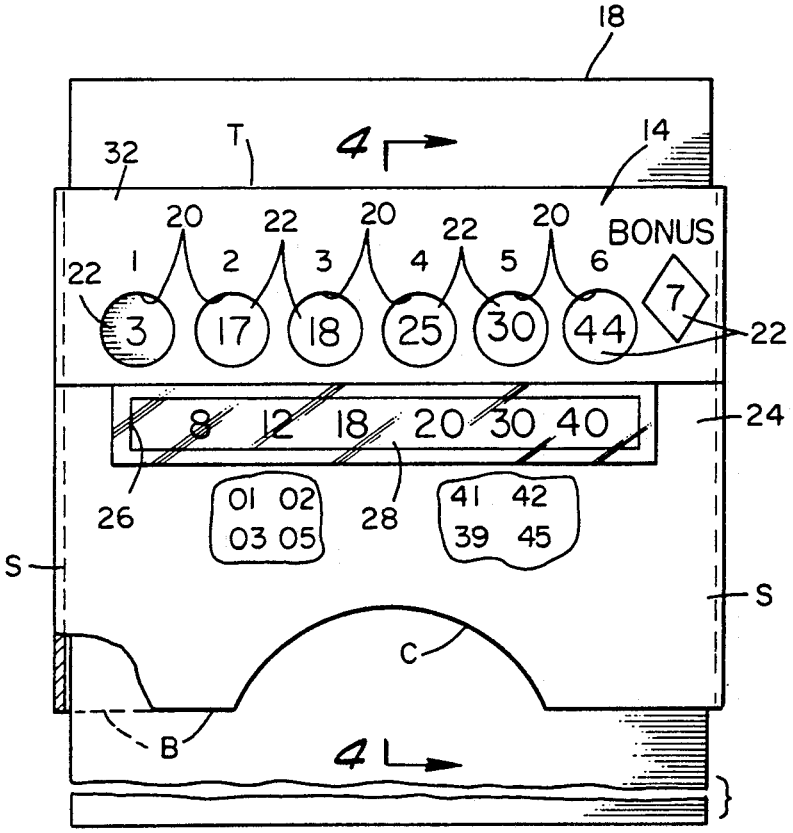
FIG. 3
FIG. 4
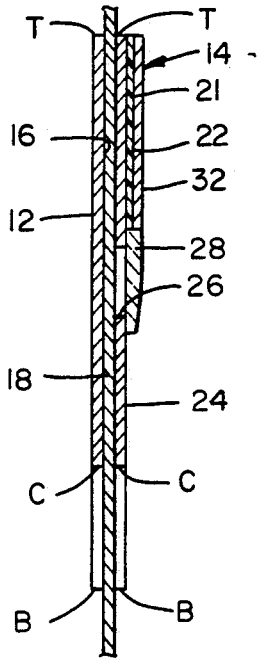

COMPARATOR

BACKGROUND OF THE INVENTION

Field of The Invention

The present invention relates generally to a comparator for comparing series of numbers. More particularly, the invention concerns a comparator device for sequentially comparing a single series of numbers imprinted on the device with several rows of numbers printed on a sheet of paper which is moved through the device.

DISCUSSION OF THE INVENTION

Introduction

In recent years many states have legalized lotto games. The games take on various forms including a lotto game in which the player pays an amount of money and then selects a series of numbers as, for example, six individual numbers from a master sheet. The master sheet is then "read" by a printing device which prints the selected numbers on a sheet of paper in a transversely extending row. At a later date, those managing the game select at random six numbers which are the "winning numbers" for that game. If the player has selected numbers which correspond to the winning numbers and presents his lotto sheet showing those numbers, he will be awarded a prize.

A variation of this game is called "Quick Pick". In this instance, instead of the player individually selecting his numbers, a machine picks at random one or more series of six numbers and prints the series of numbers in descending rows transversly extending on a thin sheet of paper somewhat resembling an adding machine tape. After the winning numbers have been selected by those conducting the game, the player compares these numbers against the numbers printed on his lotto sheet; and if a series of numbers on his lotto sheet corresponds with the winning numbers, he is awarded a prize.

In many instances, the winning numbers are read over the radio or displayed during a television program. Accordingly the lotto player must write down the winning numbers on a sheet of paper and then compare these numbers with the numbers appearing on his lotto card. The numbers on the lotto card are typically quite small and somewhat difficult to read. Accordingly if the player has selected several series of numbers, it becomes quite difficult to compare each of these series of numbers with the winning numbers which he has written down on a separate sheet of paper.

The device of the present invention is specifically designed to enable the player to imprint the winning numbers on the comparator device as the numbers are read over the radio or displayed on a television program. These numbers are transcribed on an erasable slate which is positioned beneath a series of six apertures formed in the facing assembly of the device. Disposed immediately adjacent the apertures through which the winning numbers are transcribed onto the writing slate is a transversely extending slot having mounted thereover a small magnifier.

In one form of the invention the device is backed by a backing sheet which is slightly spaced apart from the facing assembly so as to define a control passageway through which the lotto ticket can be passed. The location of the magnifier is such that as the lotto sheet is passed through the comparator device, the numbers on the lotto sheet will sequentially appear below the magnifier so that they will be magnified and can be easily compared with the winning numbers which appear immediately adjacent the magnifier. In this way several series of numbers appearing in rows on the lotto sheet can be quickly, easily and accurately compared with the winning numbers which have been written on the erasable slate. After the particular game is over, the numbers written on the slate are erased so that the comparator can be used for the next game to be played.

SUMMARY OF THE INVENTION

It is an object of the present invention to provide a comparator device which can be used to compare a first series of numbers written on the face of the device with a second series of numbers imprinted on a sheet of paper which can be fed through an internal passageway formed between the facing assembly of the device and a backing member so the numbers can be viewed through a reading window.

It is another object of the invention to provide a device of the aforementioned character in which the viewing window comprises a magnifier which magnifies the second series of numbers printed on the sheet of paper thereby making them easier to read.

Another object of the invention is to provide a device described in the preceding paragraphs in which the first series of numbers can be imprinted on a easily erasable writing surface.

Another object of the invention is to provide a comparator device of the character described which is ideally suited for use in playing lotto. When so used, the first series of numbers written on the erasable writing surface are the winning lotto numbers and the second series of numbers viewed through the magnified viewing window are the numbers selected by the lotto player.

Still another object of the invention is to provide a device of the character described in the preceding paragraphs which is compact, easy to use, and very inexpensive to manufacture.

BRIEF DESCRIPTION OF THE DRAWINGS

FIG. 1 is a generally perspective view of one embodiment of the apparatus of the present invention.

FIG. 2 is a plan view of one type of machine-printed "Lotto" sheet showing a series of lotto numbers picked by the player of the lotto game.

FIG. 3 is a plan view of the apparatus of the invention shown in FIG. 1 illustrating the manner in which the machine-printed lotto sheet is passed through a central passageway in the apparatus.

FIG. 4 is a cross-sectional view taken along lines 4—4 of FIG. 3.

DESCRIPTION OF THE INVENTION

Referring to the drawings and particularly to FIGS. 1 and 4, the apparatus of the present invention takes the form of a comparator for visually comparing a first series of numbers written on the comparator with a second series of numbers imprinted on a sheet of paper such as a machine-printed lotto sheet of the character shown in FIG. 2. The device of this form of the invention comprises a backing member 12 and a facing means generally designated by the numeral 14 which overlays backing member 12 and cooperates therewith to define a passageway 16 through which a sheet of paper, such as machine-printed lotto sheet 18 can be passed. Facing means 14 is provided with a plurality of transversely spaced apertures 20.

In the form of the invention shown in the drawings, the facing means further includes a member 21 having a writing surface 22 accessible through apertures 20 and upon which the first series of numbers can be transcribed using a suitable writing instrument such as an ink pen. Member 21 can be constructed of plastic, slate or other suitable material. The facing means also includes viewing means for viewing the second series of numbers imprinted on the machine-printed sheet 18 as the sheet is passed through passageway 16.

Referring also to FIG. 4 the facing means comprises a first member 24 provided with a transversally extending opening 26. The viewing means of the embodiment of the invention comprises a magnifying means here provided in the form of a plastic magnifier 28 which overlies transversely extending opening 26 and functions to magnify the numbers printed on the preprinted lotto sheet 18.

As best seen in FIG. 4, second member 21 is connected to the upper portion of first member 24 and apertures 20 are formed in the third cardboard or plastic member 32 which overlays second member 21 in the manner shown in FIG. 4. With this construction, numbers such as those shown in FIG. 3 as 3, 17, 18, 25, 30, 44 and 7 can be written on the writing surface 22 of member 30 through the apertures 20 provided in third member 32.

As indicated in FIGS. 1 and 4, backing member 12 and first member 24 are both generally planer in configuration and each has top, bottom and side portions designated in the drawings by the letters T, B, and S respectively. Members 12 and 24 can be constructed of cardboard, plastic or any other suitable material. As best seen in FIG. 1, members 12 and 24 are joined along their respective side portions S in a manner to form passageway 16 there between.

In using the apparatus of the invention, the lotto player, upon learning of the winning numbers in the current lotto game, as, for example, announced on the radio or on a television program, writes the winning numbers onto the writing surface 22 which is disposed beneath the apertures 20. For example, as shown in FIG. 3, the user would write the numbers 3, 17, 18, 25, 30 and 44 and the bonus number 7. This done, the user would insert the machine-printed "Quick Pick" sheet 18 into the passageway 16 and pull it through to the position wherein the first series of machine-printed numbers designated as A in FIG. 2 would appear beneath the magnifying glass 28. These numbers 8, 12, 18, 20, 30 and 40 would be magnified by the magnifying glass so that they could be easily compared with the winning numbers written onto the writing surface 22. Next, the user would slide the machine-printed sheet 18 upwardly so that the series of numbers designated as B in FIG. 2 would appear beneath the magnifying glass. Members 12 and 12 are each provided with simicircular cutouts C to expedite sliding the sheet 18 through the device. These number could then be readily compared with the winning numbers. Similarly, the user would pass the machine-printed sheet 18 upwardly through the device until each of the series of numbers designated as C, D and E in FIG. 2 would appear beneath the magnifying glass. In this way, each of the numbers selected by the user, or in this case selected by the "Quick Pick" printing apparatus, could be readily compared with the winning numbers written into the apertures designated 1, 2, 4, 5 and 6 in FIGS. 1 and 3. After the comparison was complete, the user would then wipe the numbers from the slate, or writing surface 22 to ready the device for the next game.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A comparator for visually comparing a first series of the numbers written on the comparator with a second series of numbers imprinted on a sheet of paper, comprising:

(a) a backing member;

(b) facing means overlaying said backing member for cooperation therewith to define a passageway through which the sheet of paper can be passed, said facing means having a plurality of transversely spaced apertures adjacent said viewing means and further including:

(i) a writing surface accessible through said apertures, whereby the first series of numbers can be written on said writing surface; and (ii) viewing means for viewing the second series of members imprinted on the sheet of paper as the sheet of paper is passed through said passageway.

2. A comparator as defined in claim 1 in which said facing means comprises a first member provided with a transversely extending opening and in which said viewing means comprises a magnifying means operably associated with said transversely extending opening for magnifying the second series of numbers.

3. A comparator as defined in claim 1 in which the number of said apertures in said facing means corresponds with the number of numbers in each of the first and second series of numbers.

4. A comparator as defined in claim 1 in which both said backing member and said first member each have top, bottom and side portions and in which said first member and said backing member are interconnected along said side portions thereof.

5. A comparator as defined in claim 4 in which said writing surface is provided on a second member connected to said first member and in which said apertures are provided in a third member connected to said second member.

6. A device for use in visually comparing a first series of numbers written on the device with a second series of numbers imprinted on a sheet of paper, said device comprising:

(a) a first member having a transversely extending opening;

(b) a backing member affixed to said first member in a manner to define a central passageway there between through which the sheet of paper can travel;

(c) a second member connected to said first member, said second member having a writing surface thereon; and (d) a third member connected to said second member, said third member having a plurality of transversly spaced apertures exposing said writing surface of said second member.

7. A device as defined in claim 6 in which said first member and said backing member each has top, bottom and side portions in which said first member and said backing member are connected proximate said side portions thereof.

8. A device as defined in claim 5 further including magnifying means disposed proximate said opening in said first member for magnifying the second series of numbers.

9. A device as defined in claim 8 in which said second member comprises a thin sheet of plastic having a smooth writing surface accessible through the apertures in said facing member.

10. A device for use in visually comparing a first series of numbers written on the device with a second series of numbers imprinted on a sheet of paper, said device comprising:

(a) a first planar member having top, bottom and side portions and a transversely extending opening;

(b) a backing planar member have top, bottom and side portions affixed proximate the side portions thereof to the side portions of said first member in a manner to define a central passageway there between through which the sheet of paper can travel;

(c) a second member connected to said first member, said second member having a writing surface thereon;

(d) a third member connected to said second member, said third member having a plurality of transversly spaced apertures exposing said writing surface of said second member; and (e) magnifying means disposed proximate said opening in said first member for magnifying the second series of numbers.

11. A device as defined in claim 10 further including magnifying means disposed proximate said opening in said first member for magnifying the second series of numbers.

* * * * *